United States Patent [19]

Onyshkevych

[11] 4,201,970

[45] May 6, 1980

[54] METHOD AND APPARATUS FOR TRIMMING RESISTORS

[75] Inventor: Lubomyr S. Onyshkevych, Lawrenceville, N.J.

[73] Assignee: RCA Corporation, New York, N.Y.

[21] Appl. No.: 931,744

[22] Filed: Aug. 7, 1978

[51] Int. Cl.[2] ..... H01C 10/00

[52] U.S. Cl. ..... 338/195; 29/620; 338/308

[58] Field of Search ..... 338/195, 215, 307-309; 29/620

[56] References Cited

U.S. PATENT DOCUMENTS

| | | | |
|---|---|---|---|
| 2,399,753 | 5/1946 | McLarn | 29/625 X |
| 3,028,659 | 4/1962 | Tsing Chow et al. | 29/155.5 |
| 3,422,386 | 1/1969 | Helgeland | 338/309 |
| 3,431,640 | 3/1969 | Larsson | 29/620 |
| 3,453,727 | 7/1969 | Touw et al. | 29/620 |
| 3,776,040 | 12/1973 | Gould | 338/195 X |
| 3,803,708 | 4/1974 | Wada et al. | 29/620 |
| 3,947,801 | 3/1976 | Bube | 338/308 |

*Primary Examiner*—C. L. Albritton

*Attorney, Agent, or Firm*—Samuel Cohen; William Squire

[57] ABSTRACT

A plurality of current paths, each operating a fusible link, is connected between a common first terminal and different points along a resistor whose value is to be trimmed. By applying a constant voltage between this common terminal and a second terminal at one end of the resistor, fusible links in one or more of successive ones of the paths open, effectively placing successively greater values resistance between the first and second terminals, thereby successively reducing the amount of current flow between these terminals. When the current drops to lower than a given value, no further links open and the value of the resistance between the terminals is in the desired range.

8 Claims, 8 Drawing Figures

METHOD AND APPARATUS FOR TRIMMING RESISTORS

Figure 1:
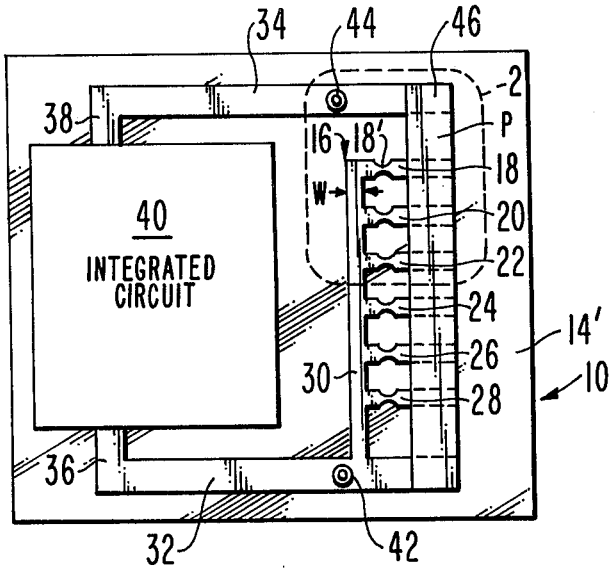

The present invention relates to the trimming of resistors such as those of the film deposited type.

Film resistor elements may be manufactured by screening a resistor material such as Rhuthenium onto a substrate, such as a porcelain coated steel sheet member. The resistor elements are interconnected by electrical conductors formed by silk screened or electroplated inks of silver or copper. The resulting structure is fired at a high temperature. The finished resistor, in the case of a "thick" film resistor, may have a thickness of 1 mil or less and in the case of "thin" film resistor, may have a thickness in the order of one or two thousand angstroms. Alternatively, other substrate materials may be employed such as phenolic or epoxy covered metal printed circuit boards which have lower firing temperature and are less expensive than porcelain coated steel. Since the metal of the substrate acts as an inexpensive heat sink, such substrates are suitable for use in the manufacture of printed power resistors of 5 watts or more capacity.

The problem with the above resistor deposition techniques is tolerance, that is, it is difficult to predict what the final value of the resistance will be, for a given screened area and other known-in-advance manufaturing perameters such as firing time, temperature and so on. The tolerance may be ±25 percent or more. In some cases, such wide variation in resistance values is not acceptable and it is necessary to "trim" the resistor to correct its value to one in the desired range. Two widely used trimming techniques are sand blasting and laser beam cutting. Both are relatively expensive. Another related technique is employed in matric construction i.e., a grid of insulated crossed conductors, wherein one or more conductors used in the matrix are deliberately broken by passing a heavy current therethrough. Another technique involves coating a portion of the resistance with a conductor to short out the undesired resistance.

An improved method for trimming a film resistance within a given resistance range in a method embodying the invention includes the steps of effectively short circuiting a plurality of separate, different portions of the resistance with a plurality of respective corresponding separate, different electrical conductors of a given current carrying capacity to form an effective resistance having a value lower than the range, and connecting a constant voltage across the resistance and portions to produce a current sufficiently greater in magnitude than that capacity to destroy one or more of the conductors when the value of the resistance is outside the given range.

Figure 2:
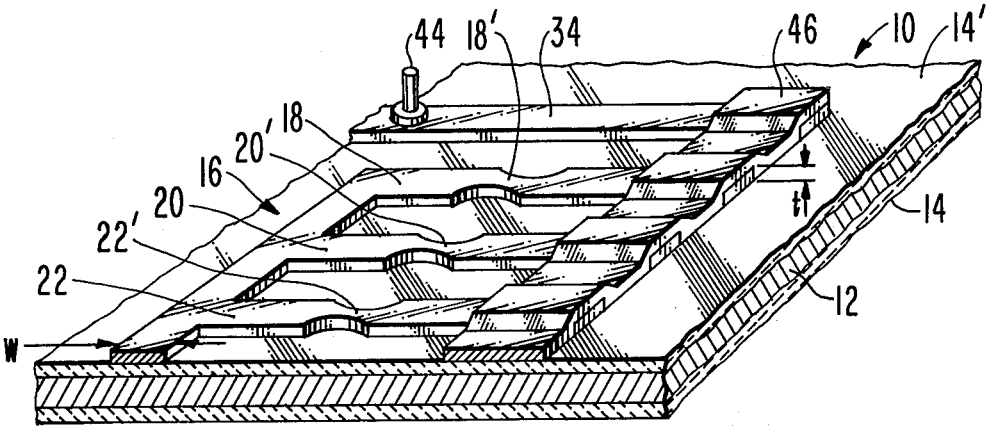
Figure 3:
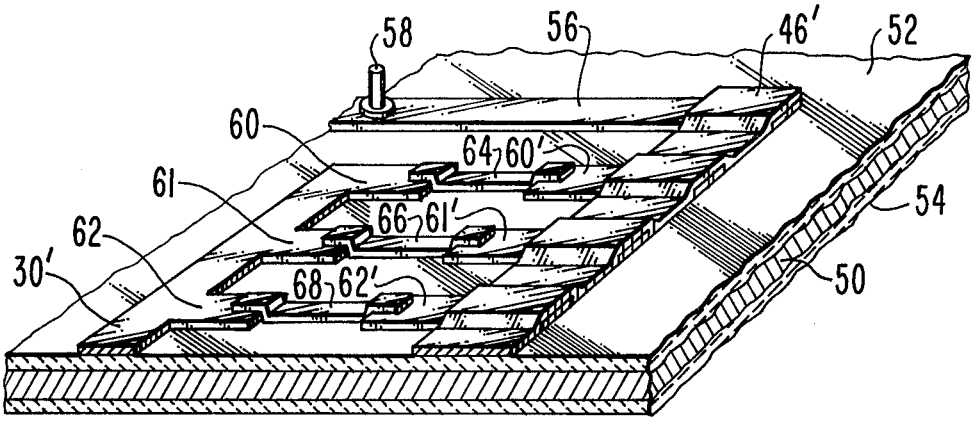
Figure 4:
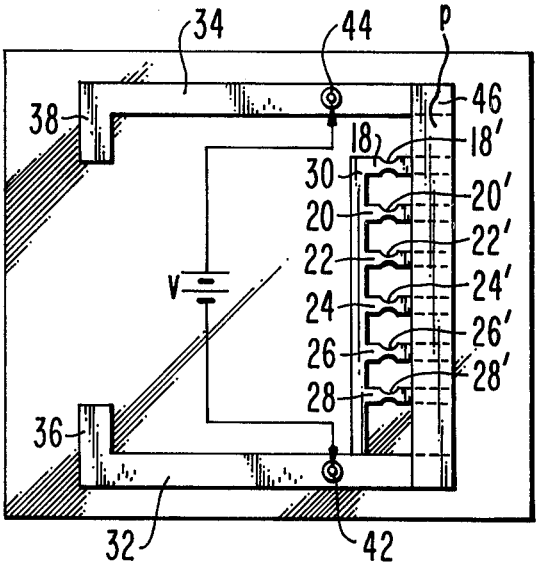
Figure 5:
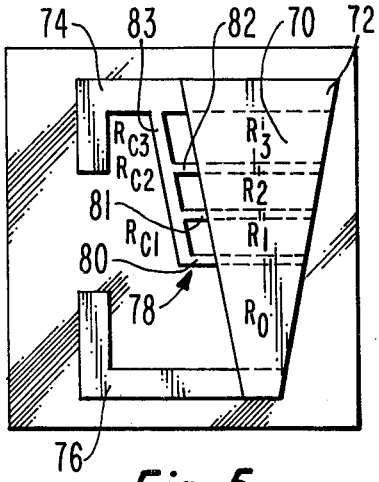
Figure 6:
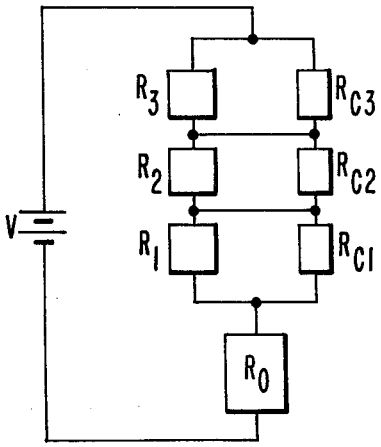
Figure 7:
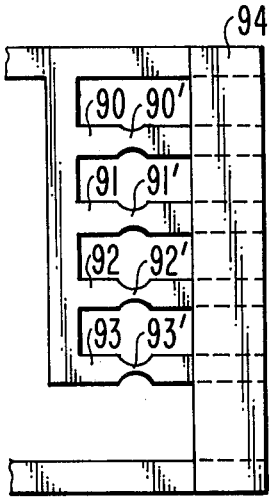
Figure 8:
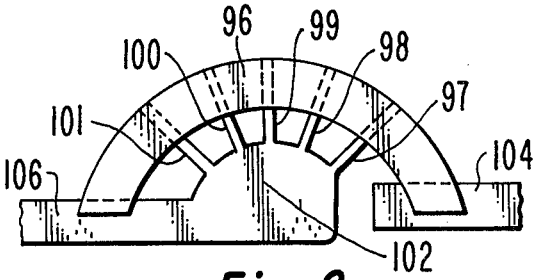

In the drawing:

FIG. 1 is a plan view of a construction illustrating an embodiment of the present invention, FIG. 2 is an isometric sectional view of the region within dashed line 2 of FIG. 1, FIG. 3 is an isometric sectional view of a construction different than that of FIG. 1 in a region comparable to that within dashed line 2 of FIG. 1, FIG. 4 is a plan view of an apparatus used to implement a process embodying the present invention, FIGS. 5, 7 and 8 are plan views of different apparatuses showing alternate configurations used in practicing the present invention, and FIG. 6 is a schematic circuit diagram useful in explaining the present invention.

The present invention is described in connection with thick-film circuits. This is not to be considered a limitation of the practice of the present invention as it may be used for thin-film circuitry, hybrid circuitry which combines thick or thin film circuitry with discrete components, discrete elements and other applications.

In FIGS. 1 and 2 a substrate 10 is formed of a sheet 12 of steel or other metal. Both sides of the sheet 12 are coated with respective layers 14 and 14' of electrical insulating material, such as porcelain which will withstand high firing temperatures. A plurality of parallel electrical conductors forming a comb 16 are deposited on one of the layers 14'. The conductors may be made of copper, silver, palladium silver or any other good electical conductor and may be formed by electroplating or in other ways. The six parallel conductive teeth or legs 18, 20, 22, 24, 26 and 28 of the comb are interconnected at one end by electrically conductive conductor 20 which extends between tooth 18 and conductor 32. Conductor 32 is formed on layer 14' at the same time as the comb 16 using the same process (electrodeposition, for example). Conductor 32 is made of the same material as the comb 16 and is integral with conductor 30. A conductor 34 is deposited on the layer 14' spaced electrically insulated from comb 16. Conductor 34 is preferably made of the same material as conductor 32 and also deposited on the layer 14' at the same time and by the same process. Conductors 32 and 34 have respective legs 36 and 38 which extend toward each other. These legs include connector means (not shown) for connection to corresponding respective connections (not shown) in the integrated circuit 40 in a conventional manner. Connectors 42 and 44 are secured to conductors 32 and 34, respectively. The integrated circuit 40 forms no part of the present invention.

Leg 18 has a narrow neck 18'. Each of the legs 20–28 have like narrow necks. Each neck in this embodiment has the same width as neck 18' (other constructions will be described later). Each of the legs 18–26 beyond its narrow neck 18' has the same width w and the same thickness t. The conductor 30 has the same thickness t and width w as legs 18–28. Since the width of each of the neck portions of the leg is the same, each leg 18–28 has the same current carrying capability. The particular dimensions of the legs at the necks is determined in accordance with the desired current to be carried in a manner to be described.

A film resistor element 46 on layer 14' is formed by silk-screening or some other technique. The resistor element 46 includes a resistor material or paste deposited on the layer 14' and over the extended ends of the legs 18–28 and conductors 34 and 32. The resistor element 46 is in electrical contact with conductors 32 and 34 and legs 18–28. The resistor paste is applied in this example as a straight element of constant width and of generally uniform thickness. It will be appreciated that due to the thickness of legs 18–28 some changes in thickness of the resistance element 46 may occur at the edges of the legs. The variation is minute and can be neglected. FIG. 2 shows this variation in thickness exaggerated. The resistor element may be formed of a paste which may be DuPont Birax paste or any other Ruthenium oxide or similar paste. The conductive legs 18–28 are equally spaced from each other so that the amount of resistive material between each pair of adjacent legs and therefore the value of resistance is approximately the same.

The value of resistance of the element 46 is designed to be higher than the desired value. To trim the resistor, a constant voltage source, FIG. 4, is connected between the terminals 42 and 44. The integrated circuit 40 is not in place at this time. The comb acts as a short-circuit between conductor 32 and leg 18 so that the entire voltage V appears across the portion p of element 46 between leg 18 and conductor 34. Assuming that the value of this portion of the resistance element 46 is higher than a predetermined lower value $R_x$ which is within the desired target range, the current flowing through it will be such that it is within the current carrying capability of the narrow neck 18' of leg 18. In this case, the resistance is used as is, with the portion p between leg 18 and conductor 34 of element 46 operating as a resistor of the desired value.

Suppose, however, that the resistance of this portion of element 46 portion p is lower in value than the predetermined value, that is, it is outside of (lower than) the target range. In this case, a V remains constant and as the value of the resistance across which this voltage appears is low, the current flow through this element portion will be relatively higher than in the first case discussed. The narrow neck 18' of leg 18 operates as a fusible link in that it is designed so that it cannot carry a current of this magnitude and will burn out. When it does, the voltage V appears across the portion of element 46 between leg 20 and conductor 34 and as this portion exhibits a resistance $R_B$ which is greater than the resistance $R_A$ between leg 18 and conductor 34, the current decreases. If, however, $R_B$ is lower than the predetermined value $R_X$, the narrow neck (fusible link) of leg 20 will burn out. This process will continue until the resistance between the closest intact leg to conductor 34 and conductor 34 is equal to or greater than $R_X$ at which time no further legs will burn out. At that time, the resistance between that intact leg and conductor 34 will be within the target range.

While in the explanation above, it is stated that there can be a case in which none of the legs 18–28 burns out, in practice if at least the first leg 18 doesn't burn out, one cannot be certain that the portion p of element 46 (between 18 and 34) isn't too large, that is, isn't above the target range. So, in practice, p is always made to have a resistance which is lower than the predetermined value $R_X$ so that at least leg 18 burns out. This is a self-checking feature.

This arrangement assumes that the conductor legs 18–28 can be made more accurately than the resistance. The cross sectional area of the conductor determines its resistance and this resistance should be within a certain range to ensure the conductor burns out with a given current. Preferably, for this reason the conductors are electroplated or etched to provide such accuracy.

The trimming procedure is self-adjusting and automatic in the sense that after silk screening and firing, the board is simply connected to a voltage source and one, or more than one, of the legs 18–28 burn out to leave a value of resistance as "seen" between terminals 42 and 44 which is within the target range, that is, the resistance element automatically is "trimmed" without further processing. Many resistance elements on a layer such as layer 14' can be trimmed simultaneously by a single applied voltage provided a voltage source (low internal resistance compared to that of the load being driven) is employed.

While the invention has been described in terms of resistors formed on porcelain metal boards substrates it is equally applicable to the trimming of resistors on phenolic boards and on other substrates. Also the substrates need not be plane members. It is understood that the number of shorting legs, in practice, can be much larger than shown to provide precise trimming. Further, while in the example illustrated the portion p of the resistor element 46 between 34 and 18 is roughly the same length as the portions between legs of the comb, in many applications, the portion p can have the major part of the final desired resistance value and the portions between the legs of the comb, each a small increment of p. The actual relative size of the various portions of element 46 depends on the particular implementation.

In FIG. 3, steel sheet 50 is coated with porcelain layers 52 and 54. A conductor 56 is deposited on the layer 52. A terminal is connected to conductor 56. A conductor 30' is deposited on layer 52. The conductor 30' has a plurality of legs 60, 61, 62 and so forth forming a comb therewith. Aligned axially with each of legs 60, 61 and 62 are strips of conductors 60', 61' and 62' and so forth. All of the conductors are made out of the same copper or silver material as described above with respect to FIG. 1. Not shown is a conductor similar to conductor 32 of FIG. 1 connected to conductor 30'. A resistance element 46' is deposited on conductor 56 and the other conductor (not shown) and one end of strips 60', 61' and 62'. Legs 60, 61, and 62 and strips 60', 61' and 62' are respectively bridged by narrow resistive elements 64, 66 and 68. The resistive elements 64, 66 and 68 have a desired resistance value, for example, one ohm, for providing a given resistance to the circuit.

The FIG. 3 structure operates in the same way as the FIG. 2 structure except resistors 64, 66 and 68 are used as the fusible links rather than the narrow necks 18' and so on of FIG. 2.

While in the forms of the present invention illustrated in FIGS. 1–4 the shorting parallel conductors 20–28, FIG. 1 and 64–68 FIG. 3 are of the same current carrying capability, the present invention is not so limited. For example, the legs may have different current carrying capabilities as shown in FIG. 7 where the legs 90–93 have necks 90'–93' of different widths. This provides different effective resistances for each segment that is shorted. The resistance element 46 also may have a resistance that is proportional to its length as shown by resistance element 70, FIG. 5. The different configurations may be useful to provide increased or different resistances for the different segments when so desired. This may be desired where space is limited with respect to increasing the size of the resistor element and it's desired to increase the effective resistance.

In FIG. 5 resistance element 70 tapers outwardly to its widest at end 72. Conductors 74 and 76 are electrically connected to each end of element 70. Comb 78 has a plurality of shorting legs 80, 81, and 82. Legs 80, 81 and 82 are interconnected at one end by conductor 83 which is connected to conductor 74. Resistance 70 is deposited in electrical contact with each of the legs 80, 81 and 82 and conductor 74. The width of each of legs 80, 81 and 82 and the conductor 83 is the same and have the same current carrying capability. However, the resistance of element 70 varies along its length. The value of the resistances formed by legs 80–83 is designated $R_0$, $R_1$, $R_2$ and $R_3$.

$R_0$ is the resistance between leg 80 and conductor 76. $R_1$ is the resistance between 80 and 81 and so forth. $R_3$ has the lowest value of resistance and $R_0$ has the greatest value of resistance. The resistance current $I_r$ flowing in resistance 70 varies along the structure due to the changes in resistance. Let the conductor across resistance element $R_1$ be called $R_{C1}$; across $R_2$, $R_{C2}$; and across $R_3$, $R_{C3}$. Leg 80 will burn out first since the current at leg 80 is higher than the current at leg 81. This removes the conductor $R_{C1}$ from the circuit. This adds resistance $R_1$ into the circuit. Each of the conductors $R_{C2}$ and $R_{C3}$ will burn out in sequence until the current is reduced to the target value of resistance. It is to be understood that the test current $I_r$ is designed to be considerably higher than any currents encountered in operation of the circuit in normal use as it is in all embodiments.

An analysis of the circuit of FIG. 5 will now be made in connection with FIG. 6. Assume that the target resistance for element 70 is 100 ohms and that the silk screening process is such that the value of the resistance can vary ±30 ohms resulting in an actual resistance in the fired configuration of the element 30 anywhere in the range of 70 ohms to 130 ohms. Assume that the value of resistance $R_0$ is 80 ohms±24 ohms, $R_1$ is 30 ohms ±10 ohms, $R_2$ 20 ohms±7 ohms, $R_3$ is 10 ohms±3 ohms and each of the $R_{C's}$ is one ohm each. Assume all other conductors have zero resistance. Also assume that the resistance $R_0$, $R_1$, $R_2$ and $R_3$ all burn out at 20 amps while $R_{C1}$, $R_{C2}$, $R_{C3}$ burn out at at least 10 amps. Other conductors are assumed to be capable of carrying much larger currents.

| HIGH RESISTANCE | |
|---|---|
| $R_0$ is 104 ohms | $R_2$ 27 ohms |
| $R_1$ is 40 ohms | $R_3$ is 13 ohms |
| Initial conditions: $R_1$, $R_2$ and $R_3$ are shorted out by the comb. | |

The total resistance is approximately 107 ohms. A constant voltage of 1000 volts is applied across the resistance element 70. The current flowing is less than 10 amps. The current through $R_{C1}$, $R_{C2}$ and $R_{C3}$ is less than 10 amps and none of the legs 80, 81 and 82 burn out. This is not the most desired case because the actual value of $R_0$ being an unknown could be much greater than the target value. Therefore, $R_0$ should always be less than the target value as follows.

| INTERMEDIATE RESISTANCE | |
|---|---|
| $R_0$ is 80 ohms | $R_2$ is 27 ohms |
| $R_1$ is 40 ohms | $R_3$ is 13 ohms |
| Initial conditions: $R_1$, $R_2$ and $R_3$ are shorted out by the comb. | |

The starting R total is approximately 83 ohms. A constant voltage of 1000 volts is applied across the resistance element 70. The current is approximately 12 amps and $R_{C1}$ burns out. This increases total resistance between 74 and 76 to 112 ohms, I reduces to approximately 9 amps. The final resistance in circuit is 112 ohms, I is approximately 9 amps, and no further adjustment occurs.

| LOW RESISTANCE | |
|---|---|
| $R_0$ is 56 ohms | $R_2$ is 13 ohms |
| $R_1$ is 20 ohms | $R_3$ is 7 ohms |
| $R_1$, $R_2$ and $R_3$ are shorted by the comb. | |

Total resistance in circuit is 59 ohms. A constant voltage 1000 is applied across the element 70. The current is (1000)/59 which is approximately 17 amps. $R_{C1}$ burns out. The total resistance is approximately 78 ohms and the current I is approximately 12 amps. $R_{C2}$ then burns out providing a total resistance of 90 ohms and the current I is approximately 11 amps. $R_{C3}$ burns out providing a total resistance of approximately 96 ohms and a current of 10. 4 amps. This is accepted. Total resistance is 96 ohms. In this case the value of the resistance portions of the element 70 that were shorted out ($R_1$, $R_2$ and $R_3$) were too coarse to provide precise correction, (3 percent or better). However, the resulting resistance range of 112 ohms to 96 ohms is compared favorably with the original variation of 130 ohms to 70 ohms. It is apparent that by providing an increased number of shorting legs across resistance element 70 additional accuracy and precision can be provided within a desired range.

A variation of the above method is used with the structure of FIG. 7. In FIG. 7 each of the legs 90, 91, 92 and 93 have a corresponding neck 90', 91', 92' and 93' of decreasing width. The narrowest width neck 93' has the lowest current carrying capability and will burn out first. As the value of the resistance is increased due to the opening of leg 93, the current is decreased. At the same time the current capability of leg 92 is higher than leg 93. Predetermining the width or thickness of the resistor element between legs 92 and 93 to a desired resistance provides additional control of the magnitude of resistance placed in the circuit. Further contol is achieved by the setting of the resistance values of the legs 90–93. In FIG. 7 the resistance element 94 is a straight member of uniform width and thickness, and, therefore, of linear resistance. However, this is not essential.

In FIG. 8 an alternate configuration is provided in which the resistor 96 is arcuate. Legs 97, 98, 99, 100 and 101 at one end are connected to a common connector pad 102 and at the other end to the resistor 96. The resistor 96 is connected at its ends between two conductors 104 and 106.

It will be equally apparent that many other alternative embodiments can be constructed and operated in accordance with the present invention. Such structure includes resistor elements which may be serpentine in shape and connected by shorting bars either at the central portions or the edge portions or any combination thereof. The shorting bar may be a straight member and the resistance element may form a comb. Also, notches may be formed in the conductive legs or teeth forming the shorting comb. The comb may be of any shape and include any arrangement of different widths.

By providing a large number of shorting legs across a given resistance element, a high degree of accuracy can be provided. The value of the voltage and the current applied to the circuit depends on the particular elements in the circuit. As indicated above, the current required to burn out the element forming the shorting legs is preferably of a higher magnitude then the design current for the circuit in its end used. There thus has been described an apparatus and a method of trimming a resistance element without the need of special tools or equipment, without any mechanical or chemical material resistance removing processes, and without the use of relatively expensive lasers, etching baths, sand blast equipment and the like. While the resistance is shown as shown deposited on a substrate it could be of any form whether lumped or film or made by any of many alternative resistance forming methods.

What is claimed is:

1. A method of trimming a resistor, to one end portion of which a first terminal is connected, to a value in a desired range comprising the steps of:

connecting between a common second terminal and N different points along the resistor N fusible links, respectively, each fusible link having a certain current carrying capacity and opening when that capacity is exceeded;

applying a constant voltage between said first and second terminals of a value such that at least the fusible link closest to said first terminal opens and a sufficient number of additional links, if any, burn out to cause the value of resistance present between said terminals to be within said desired range and the value of current flowing through any still intact fusible link to be lower than its current carrying capacity.

2. The method of claim 1 wherein said connecting step includes the step of providing the fusible links with different respective current carrying capacities.

3. The combination of:

a first terminal a resistive element electrically connected at one end portion thereof to said first terminal; the resistance of said element decreasing per unit length of said element from said first terminal, a plurality of conductor means, each electrically connected at one end portion thereof to a different point along the resistive element, and at the other end portion thereof to a common second terminal, each such conductor means being capable of carrying a particular value of current and opening when the flow of current through it attempts to exceed its particular value of current;

means for applying a constant voltage between said first and second terminals for establishing a flow of current $I_1$ between a portion $R_A$ of said resistive element between said first terminal and a first of said conductor means closest to said one terminal, said current $I_1$ resulting in a flow of current through said first conductor means, said value of voltage being chosen such that when $R_A$ is equal to or greater than a desired value $R_X$, said particular value of current of said first conductor means is not exceeded, and when $R_A$ is less than $R_X$, the particular value of current of said first conductor means is exceeded and it opens, whereby a flow of current $I_2<I_1$ flows through a portion of said resistive element $R_A+R_B$ between said first terminal and a second of said conductor means, the particular value of current for said second conductor means being chosen so that when $R_A+R_B \geqq R_X$, the current flow through said second conductor means does not exceed the same and when $R_A+R_B<R_X$, the current flow through said second conductor means causes said second conductor means to open, the process repeating for successive conductor means until a point is reached at which no further conductor means opens at which time the total resistance as seen between said first and second terminals, is equal to or greater than $R_X$.

4. A method of trimming resistance to a target range comprising:

placing at least two relatively low resistance electrically conductive members across at least two different portions of said resistance to provide an effective resistance less than said target range, said members becoming nonconductive when a current greater than a given value attempts to flow therethrough, and connecting a given constant voltage across said resistance sufficient in magnitude to generate a current having a magnitude greater than said given value to burn out at least one of said members to thereby provide an effective resistance in said target range.

5. The method of claim 4 wherein said members each have a different resistance value.

6. The method of claim 4, wherein said placing step includes depositing a thin film conductor in parallel with said portion.

7. The method of claim 6 further including, forming each member with a separate, different current carrying capacity.

8. The combination of:

first and second terminals for receiving a constant voltage, a resistive element electrically connected at one end portion thereof to said first terminal and at the other end portion to the second terminal;

a plurality of conductor means, each electrically connected at one end portion thereof to a different point along the resistive element and at the other end portion thereof to said second terminal, each such conductor means being capable of carrying a particular value of current less than the current carrying capability of the resistive element portion across that conductor means, and opening when the flow of current through it attempts to exceed its particular value of current;

said constant voltage when applied between said first and second terminals establishing a flow of current $I_1$ in a portion $R_A$ of said resistive element between said first terminal and a first of said conductor means closest to said one terminal, said current $I_1$ resulting in a flow of current through said first conductor means, said value of voltage being chosen such that when the particular value of current of said first conductor means is exceeded, it opens, whereby a flow of current $I_2<I_1$ flows through a portion of said resistive element $R_A+R_B$ between said first terminal and a second of said conductor means, the particular value of current for said second conductor means being chosen so that when $R_A+R_B \geqq R_X$, the current flow through said second conductor means does not exceed the particular value of current of the second conductor means and when $R_A+R_B<R_x$, the current flow through said second conductor means causes said second conductor means to open, the process repeating for successive conductor means until a point is reached at which no further conductor means opens at which time the total resistance, as seen between said first and second terminals, is equal to or greater than $R_X$.

* * * * *